United States Patent [19]

Fusaro et al.

[11] Patent Number: 4,824,118

[45] Date of Patent: Apr. 25, 1989

[54] METHOD OF PLAYING A BOARD GAME

[76] Inventors: William A. Fusaro, 518 Birch St., Fall River, Mass. 02724; Gabriel T. Andrade, 239 Ames St., Fall River, Mass. 02721

[21] Appl. No.: 170,426

[22] Filed: Mar. 21, 1988

Related U.S. Application Data

[62] Division of Ser. No. 11,331, Feb. 3, 1987.

[51] Int. Cl.[4] ..... A63F 3/00

[52] U.S. Cl. ..... 273/256; 273/278

[58] Field of Search ..... 273/241, 243, 256, 257, 273/278, 279, 281, 282

[56] References Cited

U.S. PATENT DOCUMENTS

| | | | |
|---|---|---|---|
| 2,026,082 | 12/1935 | Darrow | 273/256 |
| 2,976,044 | 3/1961 | Corpening | 273/256 |
| 4,076,249 | 2/1978 | Sneathen, Jr. | 273/256 |
| 4,648,601 | 3/1987 | Carmichael | 273/256 |

*Primary Examiner*—Richard C. Pinkham
*Assistant Examiner*—William E. Stoll
*Attorney, Agent, or Firm*—Salter & Michaelson

[57] ABSTRACT

A method of playing a board game is operative with a game board having a plurality of locations defining a predetermined path of progression thereon, a plurality of Connection cards representing predetermined political connections, a plurality of Payoff cards designating predetermined illegal payoffs, a plurality of game pieces and a plurality of game currency bills. A portion of the locations on the game board are various possessory real-estate locations which can be owned by game players, and preferably another portion of the locations are Connection locations which require game players to randomly select Connection cards. A portion of the real-estate locations are developable locations which can be developed by game players through the use of game currency, political connections and/or illegal payoffs. For use of the board game apparatus in accordance with the method, game players advance their game pieces along the path of progression and eventually purchase and develop the real-estate locations through the use of game currency, political connections and illegal payoffs. Game players are randomly penalized for making illegal payoffs and are required to make rental payments when their game pieces land on real-estate locations owned by other game players.

7 Claims, 3 Drawing Sheets

METHOD OF PLAYING A BOARD GAME

This application is a division of U.S. Patent application Ser. No. 011,331 filed Feb. 3, 1987.

BACKGROUND AND SUMMARY OF THE INVENTION

The instant invention relates to amusement games and more particularly to an a method of playing a novel and amusing board game.

A variety of different types of board game apparatus have been heretofore available for playing various different board games. In this regard, it has been found that board games can have significant degrees of amusement value when they incorporate interesting themes which guide and motivate the actions of game players during games. In particular, it has been found that board games which require game players to make various decisions based on logic and/or chance can have high degrees of amusement value since they can often capture the attention of game players for extended periods of time.

The instant invention provides a highly interesting and challenging board game having a novel and amusing theme. Specifically, the method of the instant invention is operable for playing a board game wherein political connections and "illegal" payoffs can be utilized for advancing the financial interests of game players as they purchase, develop and exploit various real estate interests. More specifically, the method of the instant invention is operative in connection with a board game apparatus comprising a game board having a plurality of sequential locations defining a path of progression thereon, wherein a portion of the locations are non-possessory Connection locations and a portion of the locations are various possessory real-estate locations, at least a portion of which are developable real-estate locations which can be developed by owners thereof. The board game apparatus further comprises a plurality of playing pieces for use by game players as they move along the path of progression on the game board, means for randomly determining the number of locations a player's playing piece is advanced during each turn, and currency means for use by game players for making and receiving payments during the course of games. The board game apparatus further comprises title means for indicating ownership of various real-estate locations on the game board, means for indicating political connections necessary for developing at least a portion of the developable real-estate locations, and means for randomly distributing political connections to game players as a result of their playing pieces landing on Connection locations. The board game apparatus preferably still further comprises means for randomly determining the amounts of illegal payoffs required for enhancing the development of at least a portion of the developable real-estate locations, and means for randomly penalizing individual game players who have made "illegal" payoffs to develop their developable real-estate locations. In the preferred embodiment of the board game apparatus, a potion of the locations on the game board represent penalty locations, and the means for randomly penalizing game players comprises the penalty locations, and it is operative for prescribing penalties for players when they have made "illegal" payoffs and their playing pieces land on penalty locations and for prescribing rewards for players when they have not made illegal payoffs and their playing pieces land on penalty locations. Further, the means for penalizing players is preferably operative for indicating predetermined connections which an be used to circumvent the penalty means, and the means for indicating political connections preferably comprises a plurality of Connection cards, a portion of which indicate connections with low-level political figures and another portion of which indicate connections with higher-level political figures. The means for determining payoffs preferably comprises a plurality of Payoff cards which are operable in lieu of the Connection cards for advancing the development of the developable real-estate locations owned by players, and the means for indicating ownership of the real-estate locations preferably comprises a plurality of Title cards, each card representing ownership of a different location. The means for specifying ownership of the real-estate locations preferably further specifies requirements, such as monetary payments and/or political connections, necessary for developing the developable locations and monetary rental payments which must be made to owners of real-estate locations when the playing pieces of other players land thereon. Another portion of the locations on the board preferably represent various possessory contract locations, and the board game apparatus preferably further comprises means for indicating ownership of the contract locations, the contract ownership indicating means comprising Contract cards and indicating political connections necessary for obtaining ownership of the contract locations and also for indicating sums of currency which are receivable by owners of the contract location when their playing pieces land on their own contract locations.

In order to play the game in accordance with the method of the subject invention, each player is assigned a playing piece and given a predetermined quantity of currency, and a "Bank" is established to hold the remaining currency and any unowned real-estate locations, etc. The players then take turns at moving their playing pieces along the prescribed path on the game board by advancing their playing pieces various numbers of locations during their turns as determined by the random advancement indicating means (preferably a pair of dice). When a player lands on a real-estate or contract location which is unowned by another player, he or she may purchase the previously unowned location by following a predetermined course of action which is preferably indicated on the Title card or Contract card for the location, whereupon the player is given possession of the appropriate Title card or Contract card. However, when a player lands on a real-estate location which is owned by another player, he or she must make a predetermined rental payment to the other player as indicated on the appropriate Title card. When a player lands on a Contract location which is owned by the same player, he or she is entitled to receive a monetary payment from the Bank. When a player lands on a Connection location, he or she must draw a Connection card and follow any game instructions provided thereon. After a player has purchased one or more developable real-estate locations on the game board, he or she may choose to develop these locations, such as by constructing fictitious buildings thereon, in order to receive increased rental payments when the playing pieces of other players land thereon. This may be done by paying sums of money and/or by using political connections as indicated on the Title cards. Alternatively, however, a player can develop a real-estate location by making an "illegal" payoff which is done by drawing a Payoff card and following the instructions indicated thereon with respect to making an "illegal" payment. However, if, after having made an illegal payoff, a player's playing piece lands on a penalty location, the player must pay a predetermined penalty, such as by paying a monetary fine or losing a turn, unless the player has a political connection represented by a Connection card which is sufficient to enable the player to circumvent the penalty. This basic format is followed by the game players until all of the players except one have become bankrupt, i.e., they have lost all of their assets, such as currency and real estate, until all of the developable real estate locations have been developed, or until a predetermined time limit is reached.

Accordingly, it is seen that the instant invention provides an effective game apparatus which can be utilized by game players for playing a highly amusing game. Specifically, the game apparatus is operative for playing an amusing game wherein political connections, "illegal" payoffs, and penalties resulting from "illegal" payoffs have significant impacts on the abilities of players to achieve monetary rewards. As a result, the board game apparatus and method are operable for playing a game which has an interesting and novel theme which can easily capture the attention of game players for extended periods of time.

Hence it is a primary object of the instant invention to provide a method for playing an interesting and unusual real-estate development game.

Another object of the instant invention is to provide a method for playing a game wherein political connections and "illegal" payoffs have significant impacts on the success of game players.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
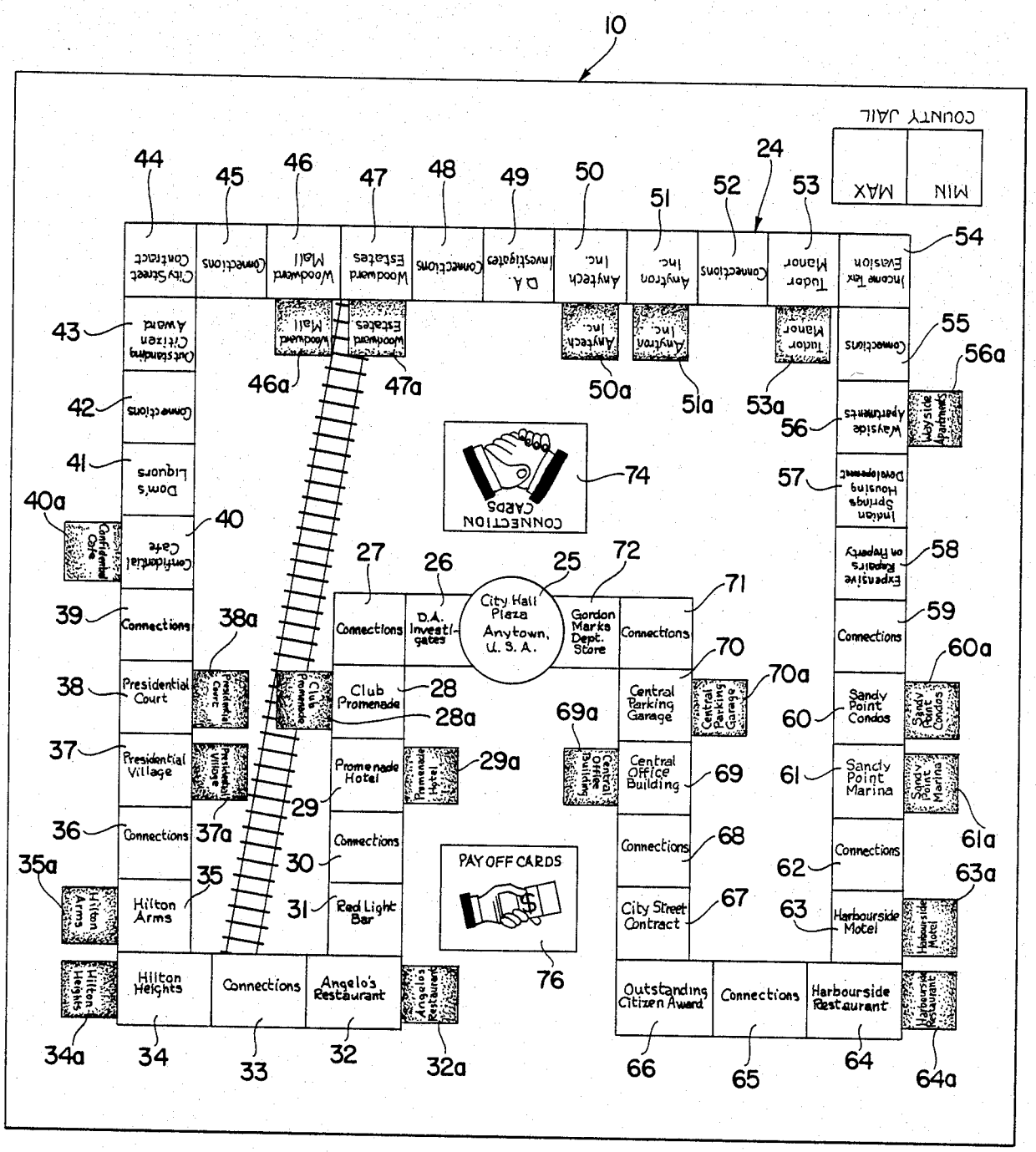
FIG. 1 is a plan view of the game board of the apparatus which is operative in connection with the method of the instant invention.
Figure 2:
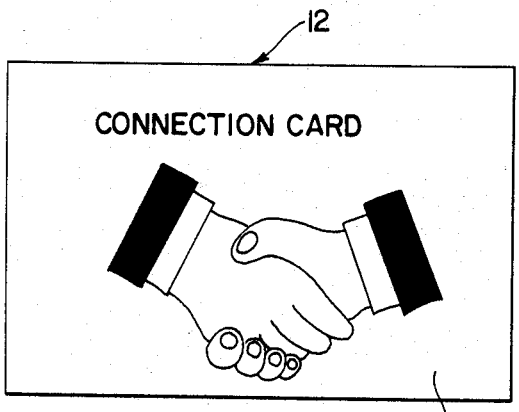
FIG. 2 is a plan view of the rear side of a connection card.
Figure 3:
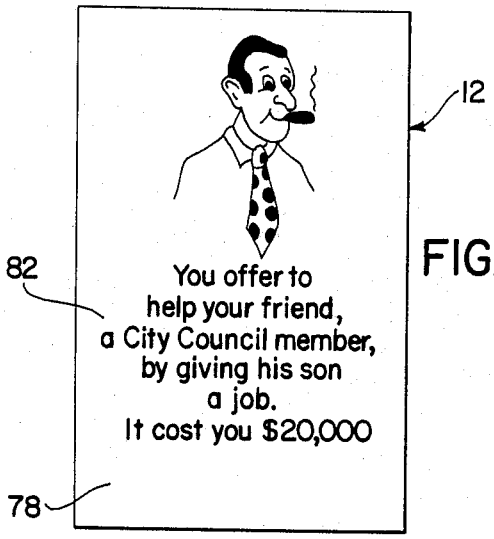
FIG. 3 is a plan view of the front side thereof.
Figure 4:
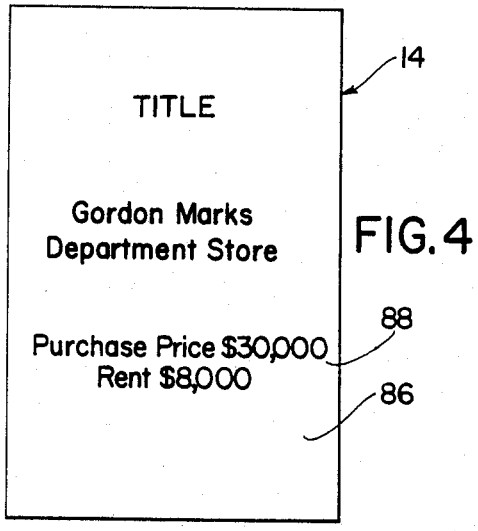
FIG. 4 is a plan view of the rear side of a real-estate title card.
Figure 5:
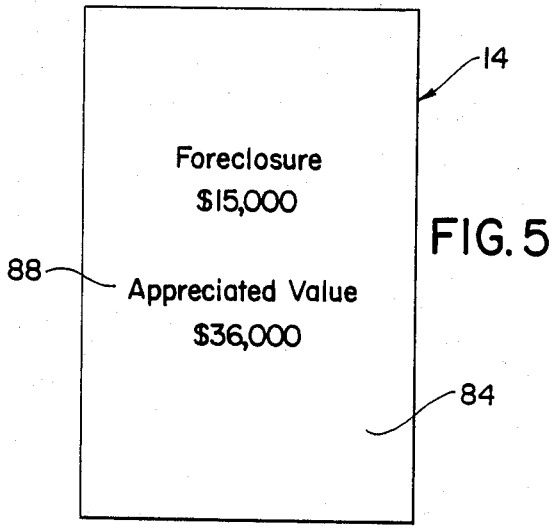
FIG. 5 is a plan view of the front side thereof.
Figure 6:
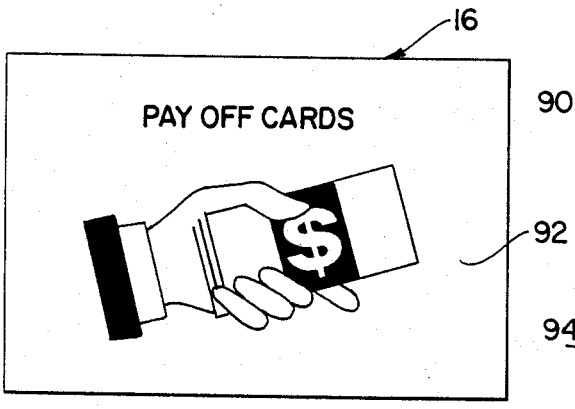
FIG. 6 is a plan view of the rear side of a payoff card.
Figure 7:
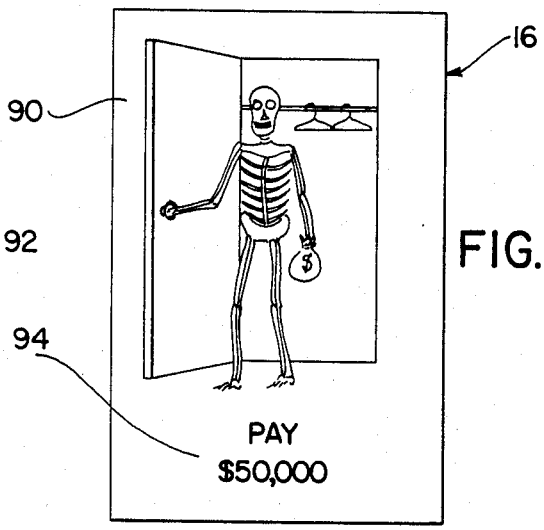
FIG. 7 is a plan view of the front side thereof.
Figure 8:
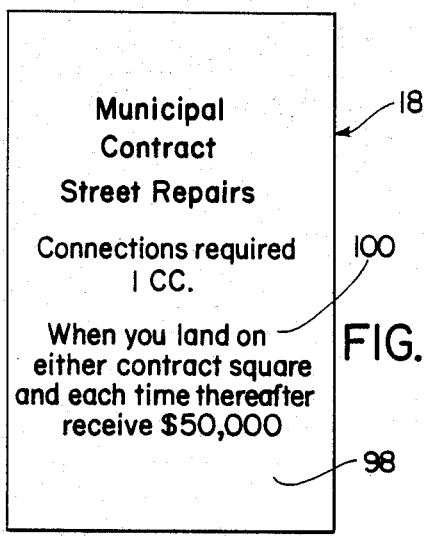
FIG. 8 is a plan view of the rear side of a contract title card.
Figure 9:
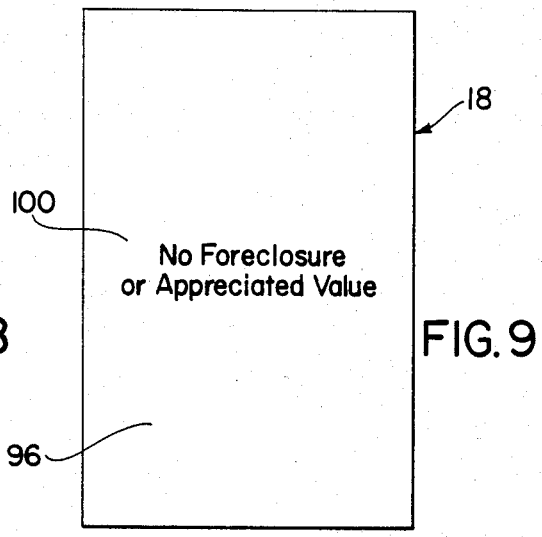
FIG. 9 is a plan view of the front side thereof.
Figure 10:
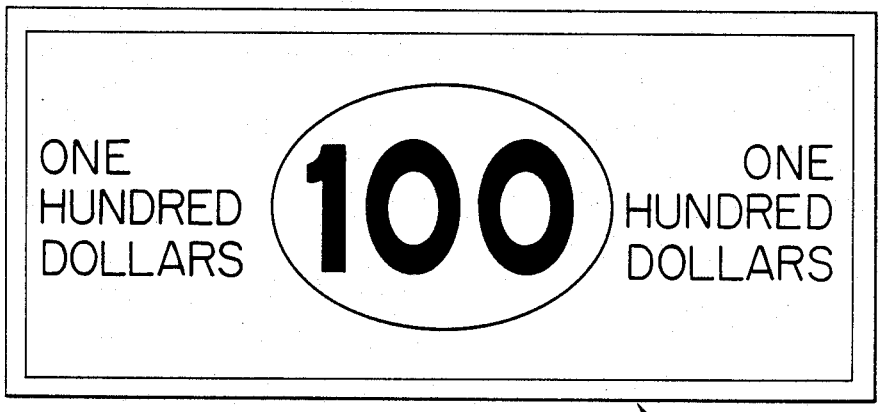
FIG. 10 is a plan view of the front side of a currency bill used in the apparatus.
Figure 11:
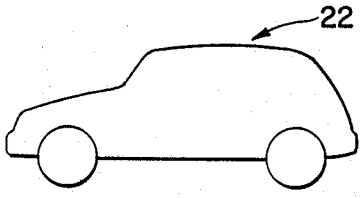
FIG. 11 is an enlarged side elevational view of a playing piece.

Referring now to the drawings, the board game apparatus which is operative in connection with the method of the instant invention is illustrated in FIGS. 1 through 12, and comprises a game board generally indicated at 10 in FIG. 1, a plurality of Connection cards of the type generally indicated at 12 in FIGS. 2 and 3, a plurality of Title cards of the type generally indicated at 14 in FIGS. 4 and 5, a plurality of Payoff cards of the type generally indicated at 16 in FIGS. 6 and 7, and a plurality of Contract cards of the type generally indicated at 18 in FIGS. 8 and 9. The apparatus further comprises a plurality of currency bills of the type generally indicated at 20 in FIG. 10, a plurality of game pieces of the type generally indicated at 22 in FIG. 11, and a pair of dice of the type generally indicated at 23 in FIG. 12.

Referring first to FIG. 1, the game board 10 has a predetermined path of advancement generally indicated at 24 thereon which is defined by a plurality of sequential locations 25 through 72. The location 25 is preferably designated as City Hall, and it preferably provides a starting location on the path 24, whereas the locations 28, 29, 31, 32, 34, 35, 37, 38, 40, 41, 46, 47, 50, 51, 53, 56, 57, 60, 61, 63, 64, 69, 70, and 72 are designated as various real-estate locations, as illustrated. Locations 44 and 67 are designated as Municipal or City Street Contract locations, locations 27, 30, 33, 36, 39, 42, 45, 48, 52, 55, 57, 62, 65, 68 and 71 are designated as Connection locations, location 58 is designated as a Repair location, locations 43 and 66 are designated as Outstanding Citizen locations, locations 26 and 49 are designated as D.A. or District Attorney penalty locations, and location 54 is designated as an Income Tax Evasion penalty location. An area 73 is designated as a Jail location, an area 74 is provided in the central portion of the board 10 for receiving a stack of Connection cards 12 thereon, and an area 76 is provided for receiving a stack of Payoff cards 16 thereon. The real-estate locations 28, 29, 32, 34, 35, 37, 38, 40, 46, 47, 50, 51, 53, 56, 60, 61, 63, 64, 69 and 70 preferably represent developable real-estate locations. Recessed areas are formed in the board 10 adjacent these locations, and development cards **28*a*, 29*a*, 32*a*, 34*a*, 35*a*, 37*a*, 38*a*, 40*a*, 46*a*, 47*a* 50*a*, 51*a*, 53*a*, 56*a*, 60*a*, 61*a*, 63*a*, 64*a*, 69*a* and 70*a*, respectively, are preferably provided in the recessed areas. In this connection, the development cards are preferably made of a cardboard material in substantially the same configurations and dimensions as their respective recessed areas in the game board 10, and they are preferably removably received therein. The development cards preferably include first sides (illustrated in FIG. 1) which are generally plain in appearance and second sides (not shown) which have pictures of various specific buildings and the like thereon, and they are alternatively positionable in their respective recessed areas so that either the first sides thereof face upwardly on the game board 10** or so that the second sides thereof face upwardly. As a result, the development cards can be initially positioned so that the first sides thereof face upwardly and then individually turned over during the course of the game to indicate that the respective real-estate locations associated therewith have been developed by game players.

The Connection cards 12 each comprise a substantially flat card which is preferably made of a suitable cardboard and has a front side 78 and a rear side 80. Provided on the front side 78 of each of the Connection cards 12 is indicia 82 which indicates a specific "connection" with a political figure which can be used by the holder of the card. Preferably the game apparatus comprises at least two types of Connection cards 12, those which provide connections with low-level political figures, such as zoning board members, and those which provide connections with higher-level political figures, such as city council members, although other types of Connections cards 12, such as those which provide connections with a mayor or other political figures, may also be included.

The Title cards 14 are also preferably made of a suitable cardboard, and they each have a front side 84 and a rear side 86. Preferably a separate title card 14 is provided for each real-estate location on the game board 10 so that the title cards can be held by game players during the course of the game as evidence of ownership of the various real-estate locations. Provided on the front and rear sides 84 and 86, respectively, of each of the Title cards 14 is indicia 88 which provides information relating to the real-estate location represented by the card 14, such as the purchase price, the foreclosure value, the appreciated value, the rent, the development cost, and any political connections required to develop the location.

The Payoff cards 16 are preferably made of a suitable cardboard material, and they each have a front side 90 and a rear side 92. Provided on the front side 90 of each of the Payoff cards 16 is indicia 94 which indicates a predetermined payoff associated with the card 16 which can be utilized in accordance with game rules for advancing a player's real-estate interests.

The Contract cards 18 are preferably made of a suitable cardboard, they are preferably each associated with a specific contract location 44 or 67 on the game board 10, and they each have a front side 96 and a rear side 98. Provided on the front and rear sides 96 and 98, respectively, of each of the Contract cards 18 is indicia 100 which indicates a contract value, the requirements for obtaining the contract, and various other information relating thereto.

The currency bills 20 preferably comprise paper "play money", and they are preferably provided in various denominations which are convenient for use in making and receiving payments in accordance with the game rules.

A plurality of playing pieces, such as the playing pieces 22, are preferably provided, each playing piece preferably being of a different configuration or of a different color in order to enable game players to distinguish their playing pieces from those of other players. The playing pieces are preferably formed in sizes which enable them to be positioned on various locations in the path 24 on the game board 10.

Figure 12:
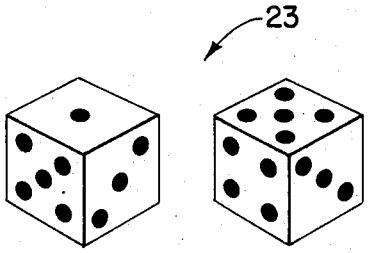
FIG. 12 is a perspective view of a pair of dice.

The dice 23 illustrated in FIG. 12 are of conventional construction, and they are operative for randomly determining the number of locations which the playing pieces of game players are advanced during their turns, it being understood that the use of various other random devices for this purpose is contemplated.

For use and operation of the game apparatus in accordance with the method of the instant invention each game player is initially given both a game piece 22 and a predetermined quantity of currency bills 20, and one game player is preferably designated as the "Banker" and given charge of the balance of the currency bills 20, as well as the Title cards and the Contract cards. A sequential playing order for the game players is then determined, and thereafter the game players sequentially roll the dice 23 and move their game pieces 22 along the path 24. When a game player lands on one of the real-estate or contract locations, he or she may purchase the location by paying a predetermined sum of currency to the Bank provided that the location has not been previously purchased by another game player. If, however, a player lands on a real-estate location which has previously been purchased by another game player, the first player must make a predetermined rental payment to the other player which depends on the specific location and whether or not the location has been developed. If a player lands on a contract location which he or she has previously purchased, the player .is entitled to receive a quantity of money represented by the currency bills 20 as a contract payment. When a game player lands on a Connection location, he or she must take a Connection card 12 and follow any instructions thereon; and when the game player lands on a location, such as the Repair location 58 or one of the Outstanding Citizen locations 43 or 66, he or she must follow predetermined game instructions. When a game player passes the City Hall location, he or she is rewarded with a monetary payment of currency bills 20 from the Bank. During the course of the game, game players may develop their developable real-estate locations, i.e., they may build fictitious buildings thereon, by making predetermined payments and/or using predetermined Connection cards as designated in the game rules in order to receive increased rental payments when the playing pieces of other players land thereon. Alternatively, game players may develop their developable real-estate locations by drawing Payoff cards 14 and following the instructions thereon. In either case, after a player has developed a specific location on the game board 10, the development card associated therewith can be turned over so that the second side thereof faces upwardly. However, if a game player lands on the Income Tax Evasion location 54 or if after having drawn a Payoff card, a game player lands on one of the District Attorney locations 26 or 49, the player must pay a predetermined fine and/or move his or her playing piece to the Jail location 73, and the player may also lose one or more turns. This general course of action is preferably followed by the game players until all of the developable real-estate locations on the game board have been developed, whereupon the game player with the most property and currency bills 20 is deemed the winner. Alternatively, the game can be played until a predetermined time limit is reached or until all but one of the game players are bankrupt, i.e., they cannot make required payments to the bank or to other game players.

It is seen therefore that the instant invention provides an effective method of playing a board game. The board game apparatus is adapted to be utilized in a game which allows game players to use political connections and/or "illegal" payoffs to achieve their goals, although game players can be penalized for using "illegal" payoffs. Further, the game apparatus is adapted to be utilized in a game which requires game players to make various logical and objective decisions in order to develop certain of their real-estate interests. Hence, it is seen that the instant invention provides a board game apparatus which is adapted to be used in connection with a novel and interesting method to play board game which has a high degree of amusement value and which can effectively capture the attention of game players for extended periods of time. Accordingly, the method of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of playing a board game comprising selecting a plurality of game players, designating a different playing piece for each game player, distributing a predetermined amount of game currency to each game player, determining a playing order and sequentially advancing the playing pieces of said game players along a predetermined path of progression on a game board, said game board having a plurality of sequential locations defining said path of progression thereon, a portion of said locations being possessory real estate locations having predetermined rental rates, a portion of said locations being connection locations and a portion of said locations being penalty locations, a portion of said real estate locations being developable through the use of legal payments of game currency to increase the rental rates thereof, a portion of said real estate locations being developable through the use of political connections to increase the rental rates thereof, a portion of said real estate locations being developable through the use of illegal payoffs to increase the rental rates thereof, each player randomly receiving political connections upon landing on said connection locations and selectively purchasing previously unpurchased real estate locations upon landing thereon, each player selectively developing his or her real estate locations through the use of legal payments of game currency, political connections, illegal payoffs of game currency or selected combinations thereof, each player making a predetermined rental payment to the owner of a real estate location owned by another player in accordance with the rental rate thereof upon landing thereon, each player receiving a game penalty upon landing on a penalty location after the player has used an illegal payoff in the development of one of his or her real estate locations.

2. In the method of claim 1, the amounts of said illegal payoffs being randomly determined.

3. In the method of claim 1, a portion of said real estate locations being developable through the use of either predetermined political connections or randomly determined illegal payoffs.

4. In the method of claim 1, said political connections being represented by connection cards, each player receiving a connection card representing a specific political connection upon landing on a connection location.

5. In the method of claim 1, each player receiving a reward upon landing on a penalty location if the player has not used an illegal payoff in the development of one of his or her real estate locations.

6. In the method of claim 1, each of said developable real estate locations having a development card associated therewith, each of said development cards having a developed side and an undeveloped side and being positioned with the undeveloped side thereof facing upwardly adjacent the associated real estate location at the start of the game, each of said game players turning the development card associated with a specific real estate location owned by the game player so that the developed side thereof faces upwardly upon development of the real estate location by the game player.

7. In the method of claim 1, said penalty further characterized as being circumventable through the use of political connections.

* * * * *